United States Patent [19]

Ueda et al.

[11] 4,420,347

[45] Dec. 13, 1983

[54] PROCESS FOR PRODUCING AN AUSTENITIC STAINLESS STEEL SHEET OR STRIP

[75] Inventors: Masanori Ueda, Kitakyusyushi; Hidehiko Sumitomo; Hirofumi Yoshimura, both of Hikarishi, all of Japan

[73] Assignee: Nippon Steel Corporation, Tokyo, Japan

[21] Appl. No.: 403,876

[22] Filed: Jul. 30, 1982

[30] Foreign Application Priority Data

Jul. 31, 1981 [JP] Japan ..... 56-120068

[51] Int. Cl.[3] ..... C21D 7/02

[52] U.S. Cl. ..... 148/12 E; 148/2

[58] Field of Search ..... 148/12 E, 2, 3

[56] References Cited

U.S. PATENT DOCUMENTS

| | | | |
|---|---|---|---|
| 3,723,102 | 3/1973 | Lowe | 148/12 E |
| 3,844,846 | 10/1974 | Friske et al. | 148/12 E |
| 3,871,925 | 3/1975 | Nunes | 148/12 E |

*Primary Examiner*—W. Stallard

*Attorney, Agent, or Firm*—Wenderoth, Lind & Ponack

[57] ABSTRACT

An austenitic stainless steel of a specific composition is cast into a slab and subjected to hot rolling, descaling, cold rolling without a step of preliminary annealing, and annealing.

The steel sheet or strip thus obtained is of excellent quality with a satisfactorily low degree of anisotropy.

4 Claims, 3 Drawing Figures

PROCESS FOR PRODUCING AN AUSTENITIC STAINLESS STEEL SHEET OR STRIP

BACKGROUND OF THE INVENTION

1. Field of the Invention

This invention relates to a process for producing a sheet or strip of an austenitic stainless steel, particularly one containing 18% Cr and 8% Ni. More particularly, it is concerned with a process which does not include annealing of a hot rolled strip, and yet can produce a product of excellent quality having a satisfactorily low degree of anisotropy.

2. Description of the Prior Art

A conventionally known process for producing a strip of an austenitic stainless steel, particularly one containing 18% Cr and 8% Ni, comprises hot rolling a slab, softening the hot rolled strip at a temperature of at least 1,000° C., descaling it, cold rolling it once or twice, annealing the cold rolled strip, and pickling it. If the strip is to be cold rolled twice, it is annealed after the first rolling. The hot strip annealing, and descaling are performed by a line known as a HAP line, designed specially for handling stainless steel.

The hot strip annealing step requires a high temperature, and a large amount of energy for softening the steel and forming a solid solution of a carbide, so this step has a significant bearing on the operating speed of the HAP line. Accordingly, eliminating this step contributes greatly to saving energy and improving productivity.

A study made by the present inventors that the hot strip annealing step is useful for the following purposes: following purposes:

(1) Recrystallizing and softening the steel sufficiently to render it suitable for cold rolling;

(2) Forming a solid solution of a carbide precipitated during the steps of hot rolling and coiling;

(3) Raising the speed of pickling; and (4) Improving the anistropy of the product.

Point (1) is discussed in Japanese Laid-Open Patent Specification No. 70404/1980, and point (2) in Japanese Laid-Open Patent Specifications Nos. 77523/1976 and 107729/1980. There are, however, still a lot of problems to be solved. The inventors known of hardly any prior study on the latter two points (3) and (4).

The inventors noted that a stainless steel strip which had not been annealed prior to cold rolling exhibits a higher degree of anisotropy than one which had been annealed. A high degree of anisotropy brings about a great difference in properties from one portion of the strip to another, i.e., in the rolling direction, in a direction perpendicular to the rolling direction, and in a direction having an angle of 45° to the rolling direction. This difference may, for example, result in a high ratio of "earing" or ear formation on a deep drawn cylindrical product, and therefore, a low yield of produciton. The earing ratio can be expressed by the following equation:

$$\text{Earing ratio } (he) = \frac{h_{max} - h_{min}}{(h_{max} + h_{min}) \times \frac{1}{2}} \times 100\ (\%)$$

in which $h_{max}$ and $h_{min}$ represent the dimensions shown in FIG. 1. A cylindrical deep drawing test for the evaluation of a strip for earing tendency may be conducted by employing a strip thickness of 0.7 mm, a blank diameter of 80 mm and a punch diameter of 40 mm. It has been found experimentally that a strip which has not been annealed prior to cold rolling exhibits an earing ratio of, say, 10%, while a strip which has been annealed shows an earing ratio of, say, 4 to 6%.

SUMMARY OF THE INVENTION

One object of this invention is to provide a process which can produce a strip of an austenitic stainless steel, particularly one containing 18% Cr and 8% Ni, without annealing the hot rolled strip prior to cold rolling.

Another object of this invention is to provide a process which can produce an austenitic stainless steel strip of superior quality having a satisfactorily low degree of anisotropy without need for annealing prior to cold rolling.

Still another object of this invention is to provide a process for the production of an austenitic stainless steel strip which provides all of the properties obtained by annealing which have hereinabove been summarized, but which does not include the step of annealing prior to cold rolling.

A further object of this invention is to provide a process for the production of an austenitic stainless steel strip which includes only a single cold rolling step.

The inventors have found that the occurrence of earling on a stainless steel strip is due to the growth of an aggregated structure peculiar thereto, and if the growth of such a structure can be inhibited, earing is reduced substantially, even if the step of hot strip annealing is eliminated. They have examined various types of steels having different chemical compositions, including austenitic stainless steels, to discover the range of proportion for each component which yields a strip having a low degree of anisotropy, and an earing ratio not exceeding 6%, even if the step of hot strip annealing is eliminated. As a result, they have discovered that the earing ratio depends principally on the nickel and carbon contents of the steel, though N and P also have a significant bearing thereon.

According to this invention, there is provided a process for producing a sheet or strip of an austenitic stainless steel, comprising the steps of casting a slab from a molten austenitic stainless steel containing, by weight, up to 0.070% carbon, up to 1.0% silicon, up to 3.0% manganese, up to 0.040% phosphorus, up to 0.030% sulfur, 16.0 to 19.0% chromium, 6.0 to 9.0% nickel and up to 0.2% nitrogen, the percentages of carbon and nickel satisfying the following relationship:

$$(102 \times \text{carbon } \%) + (4 \times \text{nickel } \%) < 39.5\%;$$

hot rolling the slab; descaling the hot rolled steel; cold rolling the steel into a sheet or strip having a predetermined thickness; and annealing the cold rolled sheet or strip.

DETAILED DESCRIPTION OF THE INVENTION

Figure 1:
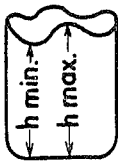
FIG. 1 is a view explaining the earing ratio.
Figure 2:
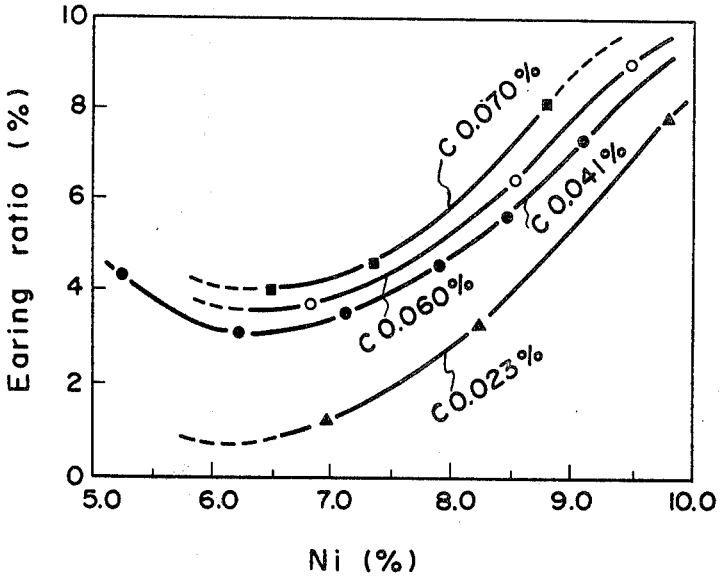
FIG. 2 is a graph showing the relationship between the earing ratio of a stainless steel strip not annealed prior to cold rolling containing 18.1% chromium, nickel and 0.03% phosphorus, and its nickel and carbon contents.

FIG. 2 shows the effects of Ni and C on the earing ratio. A reduction in the nickel content of steel from 10% to 6% lowers the earing ratio markedly. However, no further improvement can be obtained in the earing ratio even if the nickel content is reduced to a level below 6%. It is also noted that a reduction in the carbon content of steel contributes greatly to lowering the earing ratio. All the percentages shown herein are by weight.

Figure 3:
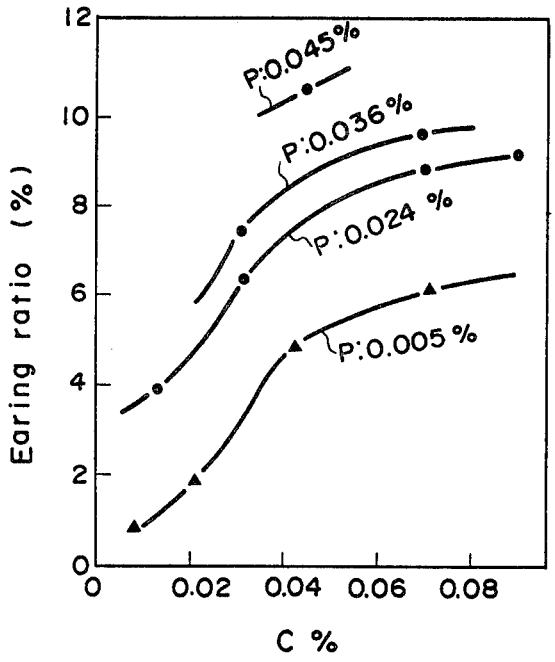
FIG. 3 is a graph showing the relationship between the earing ratio of a stainless steel strip not annealing prior to cold rolling containing 18% chromium and 8.5% nickel and its carbon and phosphorus contents.

FIG. 3 shows the effects of C and P on the earing ratio. A reduction in the carbon content of steel from 0.08% to 0.01% lowers the earing ratio drastically. It is also noted that a reduction in the phosphorus content of steel from 0.045% to 0.005% contributes greatly to lowering the earing ratio.

A reduction in the nitrogen content of steel also helps to lower the earing ratio, but chromium and sulfur have little influence on the earing ratio. A comparative study on a variety of steels having different compositions indicates that if the quantities of various elements, including not only Ni and C, but also P and N, are reduced simultaneously, a synergistic effect can be obtained for the improvement of the earing ratio. This synergistic effect is, for example, obvious from FIGS. 2 and 3.

The synergistic effect obtained by reducing the quantities of both carbon and nickel as shown in FIG. 2 can be utilized effectively to obtain an austenitic stainless steel strip having a satisfactorily low degree of anisotropy, and an earing ratio not exceeding 6%, even if the step of hot strip annealing is eliminated. In order to achieve satisfactory results, it is necessary to employ a steel containing up to 0.070% of carbon and from 6.0 to 9.0% of nickel, and ensure that the quantities of carbon and nickel satisfy the following relationship:

$$(102\times\text{carbon }\%)+(4\times\text{nickel }\%)<39.5\%; \quad (1)$$

To obtain even better results, phosphorus up to 0.040% and nitrogen up to 0.2% may be employed, in which case the quantities of carbon, nickel, phosphorus and nitrogen must satisfy the following relationship:

$$(102\times\text{carbon }\%)+(90\times\text{phosphorus }\%)+(64\times\text{nitrogen }\%+(4\times\text{nickel }\%)\leqq 43\%. \quad (2)$$

The limitations on the quantities of carbon and nickel are effective not only for improving the anisotropy of the strip, but also for fulfilling the other three functions of the step of hot strip annealing as hereinbefore summarized. According to the process of this invention, a strip is produced from a steel having lower carbon and nickel contents than the 18Cr-8Ni austenitic stainless steels known in Japan by the designation of SUS 304. The steel is softened to a greater extent when it has been hot rolled, a smaller quantity of a carbide is precipitated when the steel is cooled and wound into a coil, and the strip can be pickled at a higher speed.

It has experimentally been discovered that the earing ratio (he) of the strip and the quantities of the various elements in the steel have the following relationship:

$$\text{he }(\%=(102\times\text{carbon }\%)+(90\times\text{phosphorus }\%)+(64\times\text{nitrogen }\%)+(4\times\text{nickel}\%)-37\% \quad (3)$$

The following ranges of quantities have been found to satisfy the relationship of equation (3) to obtain a satisfactorily low earing ratio:

C—0.01 to 0.10%
Mn—0.4 to 5.0%
S—0.001 to 0.030%
Ni—5.0 to 10.0%
Cu—0.05 to 2.5%
Ti—0.01 to 0.6%
Nb—0.01 to 0.7%
Si—0.2 to 1.3%
P—0.003 to 0.045%
Cr—16.0 to 19.0%
Mo—0.05 to 2.4%
N—0.008 to 0.2%
Al—0.01 to 0.3%

Further limitations are required in the quantities of the various elements of steel as already set forth, and as will hereinafter be explained.

Carbon has a significant bearing on the anisotropy of an austenitic stainless steel strip produced without the step of annealing prior to cold rolling. The upper limit on the quantity of carbon is 0.070% to achieve satisfactory grain boundary corrosion resistance, and a still lower upper limit is desirable if it is industrially and economically possible.

The upper limit on the quantity of phosphorus is 0.040% in order to ensure that a satisfactorily low degree of anisotropy be achieved. A still lower upper limit is preferred if it is industrially and economically possible.

The quantity of nickel also has a significant bearing on the anisotropy of an austenitic stainless steel strip produced without the step of annealing prior to cold rolling. The upper limit is 9%, but a reduction to a level below 6% produces no further improvement.

Control over the quantity of nitrogen is also essential to ensure a satisfactorily low degree of anisotropy. The upper limit is 0.2%, and a still further reduction is desirable it it is industrially and economically possible. It is, however, important to limit the quantity of nitrogen to a maximum of 0.2% in order to produce a strip having high strength.

Although chromium does not have any substantial bearing on the anisotropy, it is necessary to employ at least 16.0% of chromium to produce an austenitic stainless steel strip having excellent corrosion resistance and workability. On the other hand, it is necessary to limit its quantity to a maximum of 19.0% in order to obtain a stabilized austenitic structure in conjunction with nickel.

It has already been pointed out that the quantities of certain elements, such as carbon and nickel, should satisfy the certain relationships as expressed by formulas (1) and (2) in order to achieve the combination of low earing ratio and the other results hitherto fulfilled by the step of annealing prior to cold rolling.

The other elements that austenitic stainless steel usually contains do not have any particular bearing on the anisotropy of the strip.

The invention will now be described more specifically with reference to several examples thereof.

EXAMPLES 1 TO 4, AND COMPARATIVE EXAMPLES 5 AND 6

A number of variations of the so-called 18Cr-8Ni austenitic stainless steel series having different compositions as shown in TABLE 1 were melted by an electric furnace and the AOD process, and continuously cast into slabs each having a thickness of 160 mm. Each slab was heated to 1,240° C., and rolled into a hot rolled strip having a thickness of 3 mm. The hot strip was passed through an annealing furnace without being annealed therein, shot blasted and pickled. COMPARATIVE EXAMPLES 5 and 6 represent strips produced from steels not conforming to the requirements of this invention. The strip of COMPARATIVE EXAMPLE 5 was produced withoug being annealed prior to cold rolling, while the strip of COMPARATIVE EXAMPLE 6 was obtained by annealing prior to cold rolling. They were shot blasted, and pickled. Each strip, whether according to this invention or not, was then cold rolled once, and annealed to yield a product having a thickness of 0.7 mm.

Various properties of the strips thus obtained were tested. The results are shown in TABLE 2. TABLE 2 indicates a great difference in earing ratio between the products of this invention and that of COMPARATIVE EXAMPLE 5, though there is no appreciable difference in other respects. The products of this invention were satisfactorily low in earing ratio, and more than comparable to the strip of COMPARATIVE EXAMPLE 6 obtained by annealing prior to cold rolling.

TABLE 1

| | Composition (wt. %) | | | | | | | | | | Formula | Formula | Hot Strip |
|---|---|---|---|---|---|---|---|---|---|---|---|---|---|
| | C | Si | Mn | P | S | Cr | Ni | N | Mo | Cu | (1) | (2) | Annealing |
| Example 1 | 0.032 | 0.65 | 0.99 | 0.031 | 0.006 | 18.3 | 8.55 | 0.022 | 0.11 | 0.13 | Satisfied | Satisfied | Omitted |
| Example 2 | 0.062 | 0.44 | 2.11 | 0.022 | 0.008 | 16.8 | 7.61 | 0.026 | 0.09 | 0.12 | Satisfied | Satisfied | Omitted |
| Example 3 | 0.026 | 0.89 | 1.33 | 0.035 | 0.007 | 18.6 | 8.21 | 0.055 | 0.13 | 0.09 | Satisfied | Satisfied | Omitted |
| Example 4 | 0.044 | 0.25 | 1.26 | 0.027 | 0.004 | 18.1 | 8.15 | 0.021 | 0.41 | 0.36 | Satisfied | Satisfied | Omitted |
| Comparative Example 5 | 0.051 | 0.66 | 1.01 | 0.031 | 0.004 | 18.4 | 8.71 | 0.044 | 0.12 | 0.09 | Not satisfied | Not satisfied | Omitted |
| Comparative Example 6 | 0.077 | 0.66 | 1.01 | 0.033 | 0.005 | 18.2 | 8.66 | 0.038 | 0.09 | 0.11 | Not satisfied | Not satisfied | Done |

Formula (1) $(102 \times C\ \%)+(4\times NI\ \%)\leqq 39.5\%$
(2): $(102\times C\ \%)+(90\times P\ \%)+(64\times N\ \%)+(4\times NI\ \%)\leqq 43\%$

TABLE 2

| | Properties of strip having a thickness of 0.7 mm | | | | | | | |
|---|---|---|---|---|---|---|---|---|
| | Tensile Properties | | | | | Earing | Erichsen | Grain |
| | Yield Strength ($kg/mm^2$) | Tensile Strength ($kg/mm^2$) | Elongation (%) L | 45° | C | ratio (%) | value (mm) | Size No. |
| Example 1 | 23.3 | 66.9 | 54.2 | 59.1 | 60.1 | 4.7 | 14.7 | 6.9 |
| Example 2 | 23.9 | 68.2 | 55.8 | 59.2 | 59.8 | 3.1 | 14.6 | 7.0 |
| Example 3 | 28.2 | 69.9 | 56.0 | 58.8 | 59.1 | 4.9 | 14.3 | 7.3 |
| Example 4 | 25.3 | 67.1 | 54.9 | 59.1 | 61.2 | 4.0 | 15.1 | 7.7 |
| Comparative Example 5 | 24.4 | 68.8 | 51.4 | 60.3 | 61.2 | 8.8 | 14.7 | 7.6 |
| Comparative Example 6 | 26.5 | 69.2 | 54.3 | 58.8 | 59.1 | 5.1 | 14.8 | 6.9 |

What is claimed is:

1. A process for producing a sheet or strip of an austenitic stainless steel, comprising:

casting a slab from a molten steel containing, by weight, up to 0.070% carbon, up to 1.0% silicon, up to 3.0% manganese, up to 0.040% phosphorus, up to 0.030% sulfur, 16.0 to 19.0% chromium, 6.0 to 9.0% nickel and up to 0.2% nitrogen, the percentages of carbon and nickel satisfying the following relationship:

$$(102\times \text{carbon}\ \%)+(4\times \text{nickel}\ \%)<39.5\%;$$

hot rolling said slab;

descaling said hot rolled steel;

cold rolling said steel; and annealing said cold rolled steel.

2. A process as set forth in claim 1, wherein said steel contains quantities of carbon, phosphorus, nitrogen and nickel which satisfy the following relationship:

$$(102\times \text{carbon}\ \%)+(90\times \text{phosphorus}\ \%)+(64\times \text{nitrogen}\ \%+(4\times \text{nickel}\ \%)\leqq 43\%.$$

3. A process as set forth in claim 1, wherein said steel contains quantities of carbon, phosphorus, nitrogen and nickel which satisfy the following relationship:

$$(102\times \text{carbon}\ \%)+(90\times \text{phosphorus}\ \%)+(64\times \text{nitrogen}\ \%+(4\times \text{nickel}\ \%)-37\%\leqq 6\%.$$

4. A strip of an austenitic stainless steel containing, by weight, up to 0.07% carbon, up to 1.0% silicon, up to 3.0% manganese, up to 0.040% phosphorus, up to 0.030% sulfur, 16.0 to 19.0% chromium, 6.0 to 9.0% nickel and up to 0.2% nitrogen, the percentages of carbon and nickel satisfying the following relationship:

$$(102\times \text{carbon}\ \%)+(4\times \text{nickel}\ \%)<39.5\%.$$

* * * * *